US008065942B2

(12) United States Patent
Loehnert et al.

(10) Patent No.: US 8,065,942 B2
(45) Date of Patent: Nov. 29, 2011

(54) ARMORING ELEMENT OF A KNIFE HAFT FOR CONNECTING TO A KNIFE BLADE AND METHOD FOR PRODUCING A KNIFE

(75) Inventors: Horst Loehnert, Ostfildern (DE); Wilhelm Leuze, Esslingen (DE)

(73) Assignee: Friedr. Dick GmbH & Co. KG, Deizisau (DE)

( * ) Notice: Subject to any disclaimer, the term of this patent is extended or adjusted under 35 U.S.C. 154(b) by 827 days.

(21) Appl. No.: 11/727,680

(22) Filed: Mar. 28, 2007

(65) Prior Publication Data

US 2007/0227014 A1 Oct. 4, 2007

(30) Foreign Application Priority Data

Mar. 31, 2006 (DE) ..... 10 2006 015 590

(51) Int. Cl.
*B25G 1/00* (2006.01)
*B26D 1/00* (2006.01)

(52) U.S. Cl. ..... 83/13; 30/329; 30/340; 30/344

(58) Field of Classification Search ..... 30/340, 30/329, 337, 344; 76/119; 16/430; 83/13
See application file for complete search history.

(56) References Cited

U.S. PATENT DOCUMENTS

| | | | | |
|---|---|---|---|---|
| 1,420,342 | A | 6/1922 | Richard | |
| 3,185,001 | A * | 5/1965 | Viator | 81/177.1 |
| 3,481,038 | A * | 12/1969 | Cooper | 30/344 |
| 5,210,925 | A * | 5/1993 | Morgulis | 29/527.4 |
| 5,269,045 | A * | 12/1993 | DeSerio et al. | 16/422 |
| 6,070,329 | A * | 6/2000 | Gibbs | 30/344 |
| 6,408,524 | B1 * | 6/2002 | Lai | 30/324 |
| 2007/0256276 | A1 * | 11/2007 | Holland-Letz | 16/111.1 |

FOREIGN PATENT DOCUMENTS

| | | |
|---|---|---|
| DE | 36 22 596 | 1/1987 |
| DE | 88 01 506 | 5/1988 |
| DE | 44 09 976 | 8/1994 |
| DE | 44 29 063 | 2/1996 |
| DE | 199 12 170 | 12/2000 |
| DE | 102004017761 | * 11/2005 |

OTHER PUBLICATIONS

Translation of the claims and specification of DE88 01 506.*

* cited by examiner

*Primary Examiner* — Boyer D Ashley
*Assistant Examiner* — Omar Flores-Sánchez
(74) *Attorney, Agent, or Firm* — Paul Vincent

(57) ABSTRACT

The invention comprises an armoring element (1) of a knife haft, which has a bar (10) extending in an axial direction (100) and is connected to the tang (20) of a knife blade (2) using a connecting means (11). A secure, frictional connection in an axial direction (100) between the armoring element (1) and the knife blade (2) is formed by positive locking and/or material bonding between the connecting means (11) of the armoring element (1) and a corresponding counter piece (21) on the tang (20) of the knife blade (2). In an inventive method for producing a knife, the tang (20) and the armoring element (1) are coated with haft material, e.g. haft shells in the connected state. The haft material forms the actual body of the knife haft, wherein parts of the surface of the armoring element (1) may be disposed in the outer surface of the knife haft such that they are visible.

11 Claims, 2 Drawing Sheets

ARMORING ELEMENT OF A KNIFE HAFT FOR CONNECTING TO A KNIFE BLADE AND METHOD FOR PRODUCING A KNIFE

BACKGROUND OF THE INVENTION

The quality of a knife largely depends on the connection between the knife haft and the knife blade. In most production methods, the knife blade has a connecting piece that projects into the knife haft. This connecting piece is called the tang. In order to form the knife haft, the haft shells are riveted, screwed or glued at the tang. The tang extends through the knife haft and is usually visible at the side surfaces, and also at the haft head when it passes through the entire length of the haft. A further possibility of connecting the knife haft and knife blade is to screw the knife blade to the knife haft as disclosed e.g. in DE 44 09 976 A1. As a further alternative, the knife haft is designed by injecting a haft material, frequently a thermoplastic material, around the tang.

The tang is usually integral with the knife blade and consists of the same material as the knife blade itself, in most cases of a high-quality steel, in particular, stainless steel. In order to ensure stable connection to the knife haft, the tang must project by a minimum length into the knife haft. This is disadvantageous in that high-quality, expensive blade material must be used to produce knifes, which is not available as part of the blade for cutting during future use of the knife.

It is the underlying purpose of the invention to develop a connection between a knife haft and a knife blade which reduces the amount of blade material used for connection with the knife haft and at the same time simplifies production.

SUMMARY OF THE INVENTION

This object is achieved by providing an armoring element of a knife haft, in particular, of metal. The armoring element has at least one bar which extends in an axial direction, and at least one connecting means provided at the end of the bar, wherein the connecting means is designed to form a non-positive connection in an axial direction to a corresponding counter piece provided on a tang of a knife blade.

The inventive armoring element is connected to the tang of a knife blade using the connecting means, such that the bar of the armoring element projects into the knife haft as an elongation of the tang. In this fashion, the section of the knife blade that projects into the knife haft has a minimum length and the amount of the blade material used to connect the knife haft is minimized. A different, in particular, less expensive material than the blade material may be used for the armoring element. The invention is also advantageous in view of production in that different knife blades and different knife haft shapes and sizes can be combined with each other through selection of corresponding armoring elements.

The connection between the armoring element and the knife blade is frictional in an axial direction, i.e. in the direction defined by the knife blade and the bar of the armoring element, and thus cannot be released in this direction. The connection is produced by positive locking and/or material bonding between the connecting means of the armoring element and a corresponding counter piece at the tang of a knife blade.

In a preferred embodiment of the inventive armoring element, the connecting means is a formed-on piece, e.g. a projection, or a recess, e.g. a hole, in the end area of the bar.

A connecting means of this type provides positive locking which is realized by fitting connecting means and counter piece into each other.

Engagement between the two parts to be connected ensures secure connection in the axial direction, whereby a connecting means of this type has an area that can be engaged behind, which is directed transversely to the axial direction and faces away from the connecting end of the armoring element. The recess or formed-on piece is preferably provided on a connecting surface which abuts or is supported between the connecting means and the counter piece on a corresponding surface of the tang in the positive locking state. The production of a plug connection between a formed-on piece and a recess, which are each provided like counter pieces on the tang, and the armoring element represents a simple production step.

For material bonding, the connecting means of the armoring element may be designed as a surface which is glued, welded, soldered, or fixed in a different fashion to the counter piece of the tang, which is also flat. When positive locking is realized using a plug connection between the connecting means and the counter piece, such additional production steps for connection can be omitted.

The connecting means is moreover preferably oriented transversely to the axial extension of the bar.

In this embodiment of the inventive armoring element, the connecting means and a corresponding counter piece can be joined together and released only in a radial direction, extending transversely to the axial direction of frictional locking. The insertion or release direction of the connection is moreover advantageously oriented approximately transversely to the direction of main load of the knife (the direction of a cutting motion performed with the knife) such that the release direction of the connection is not loaded during normal use of the knife.

In a further preferred embodiment of the armoring element, the at least one bar has at least one transverse part which radially projects past the bar.

A transverse part provided on the bar gives the inventive armoring body a skeleton-like structure which increases the stability of a knife haft to be formed. A transverse part provided on the connecting end of the armoring element may moreover stabilize the connection between the connecting means and the counter piece in that the transverse part abuts the end and/or side surfaces of the tang when the armoring element is connected, thereby preventing rotation, tilting or sliding of the connection. The number and the design of the transverse parts provided on the armoring element determine the overall weight of the armoring element, which is advantageous in that a certain weight of the knife haft of armoring element and haft material can be adjusted. For this reason, a balanced knife can be produced which is characterized by a certain weight distribution of knife haft and knife blade.

In a preferred embodiment of the armoring element, the at least one bar and the at least one transverse part are designed at least approximately mirror-inverted relative to a central plane of the armoring element.

A symmetrical design of the inventive armoring element facilitates symmetrical design of the knife haft. The connecting means is preferably oriented such that the knife blade is disposed in the symmetry-defining central plane of the armoring element when the knife blade and the knife haft have been connected. The mirror-inverted design of the armoring element moreover ensures that the knife haft is weight-balanced, which is advantageous for handling the knife.

The at least one transverse part moreover advantageously comprises holes in the axial direction.

The holes which are provided preferably symmetrically on the transverse part(s) not only balance the weight but also fix the tang, with the connected armoring element, in the knife haft. In one design of the knife haft of a flowable haft material, material bridges are formed by the holes via which a section of the knife haft disposed in front of the transverse part and a section disposed behind a transverse part are connected. When several transverse parts are disposed behind one another and when the holes are correspondingly disposed, material sheets are produced which pass through the entire length of the knife haft, thereby connecting it rigidly to the armoring element and the knife blade.

In a further preferred embodiment, the armoring element is characterized in that it is formed in one piece.

A one-piece design of the inventive armoring element ensures high stability of the armoring element and is advantageous in view of production in that a knife to be produced substantially has a two-piece structure of knife blade and armoring element. The armoring element may be sintered, reshaped, milled, cast, injected or processed in a different mechanical fashion and is preferably designed as a shaped part.

The invention also concerns a knife comprising an inventive armoring element which has at least one bar extending in an axial direction and at least one connecting means provided at the other end of the bar, and a knife blade with a tang comprising a counter piece of the connecting means. The connecting means and the counter means are thereby frictionally connected to each other in an axial direction, and the tang and the armoring element are at least partially surrounded by a haft material.

The connection between the knife blade and the knife haft of the inventive knife is provided by an axial frictional connection between the armoring element and the knife blade. The material bonding and/or positive locking between the connecting means and the counter piece ensures the frictional connection, wherein positive locking is preferably designed as a plug connection which can be realized with simple technical means. The tang and the armoring element are surrounded by haft material, e.g. haft shells, wherein parts of the armoring element and/or tang may remain visible. The haft material structures and forms the actual body of the knife haft. An armoring element may serve as a basic frame for different knife haft elements using different haft shells.

In a preferred embodiment of the inventive knife, the haft material is a hardenable injected or cast substance which hardens on a permanent basis after being injected around the armoring element.

A cast or injected knife haft, which consists e.g. of a thermoplastic material, offers a smooth, often pore-free surface which ensures simple cleaning without leaving residues, and thus optimum hygiene. An armoring element with holes in the transverse parts and/or in the bar is fixed and anchored with great stability in a knife haft of hardenable injected or cast substance due to the material bridges created in the holes.

In a further preferred embodiment, the tang is disposed in the plane of the knife blade.

The arrangement of the tang, which is preferably designed as a flat piece, in the plane of the knife blade is advantageous in that the knife blade can be produced in a simple fashion, e.g. through punching, and the armoring element can advantageously be connected in a radial direction which is transverse to the direction of main load of the knife. The knife blade preferably has a forged, pressed or welded offset on which the tang is formed in one piece. In a preferred embodiment of the knife blade, the tang is punched. The handling safety of the knife haft is increased by the offset, which serves as a front hand protection, and by selection of an anti-slip haft material.

The invention also concerns a method for producing an inventive knife which comprises an armoring element with at least one bar extending in an axial direction, at least one connecting means provided at the end of the bar, and a knife haft with a tang comprising a counter piece for the connecting means. In a first step 1, the connecting means and the counter means are connected to each other. In a second step 2, the haft material is mounted to the tang and the armoring element.

The inventive method for producing a knife is characterized by the small number of steps. After establishing the basic body, which consists of two parts, i.e. the knife blade and the armoring element, the desired knife haft is formed thereon using haft material. The haft material may comprise haft shells which are glued, riveted or screwed on the armoring element and/or the tang.

In a preferred variant of the inventive method, a hardenable injection or casting substance is injected or cast around the tang and the armoring element in step 2, followed by a further step 3, i.e. hardening of the injected or cast substance.

In this embodiment variant, the knife haft is injected or cast on. After hardening of the injected or cast substance, the knife haft, armoring element, and the knife blade which is frictionally connected to the armoring element, form an inseparable unit. This type of connection of the haft material does not require any additional steps for mounting to the armoring element and tang.

In a further preferred embodiment of the inventive method, the tang and the armoring element are coated in step 2 in such a fashion that at least parts of the surface of the armoring element are disposed at the outer surface of the knife haft.

In this preferred method variant, the armoring element serves as a shaping element, as a knife-characterizing element, and moreover as a design element.

Further advantages of the invention can be extracted from the description and the figures of the drawing. The inventive armoring element and the inventive knife are illustrated in different embodiments and in different states of the inventive method in FIGS. 1*a* through 1*d*, 2*a* and 2*b*. The embodiments shown in the figures are highly schematic and are not to be taken to scale. The individual reference numerals designate the same features in different embodiments.

DESCRIPTION OF THE PREFERRED EMBODIMENT

Figure 1A:
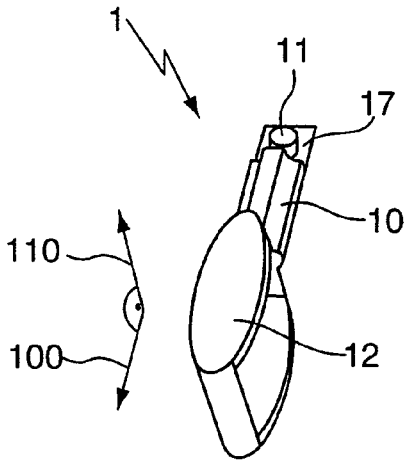
FIGS. 1*a* through 1*d* each show perspective views of an inventive armoring element.

FIG. 1*a* shows an armoring element 1 which has a bar 10 extending in an axial direction 100. One end of the bar 10 has a connecting means 11 which is designed as a pin-like projection on an end surface 17 of the bar 10. The connecting means 11 is oriented in a radial direction 110, which is transverse to the axial direction 100 (the direction of extension of the bar 10). By fitting the connecting means 11 in a radial direction 110 into a counter piece of a tang, which is designed as a recess or hole, positive locking may be realized, which is secure and frictional in direction 100 and exclusively detachable in the radial direction 110. When the armoring element 1 is connected to a tang of a knife blade, the end surface 17 may abut the tang. On the other hand, the beam-like bar 10 has a rear transverse part 12. The rear transverse part 12 is composed of two parallel elliptical surfaces which are connected to each other at both narrow end sides and have the shape of a cylinder which is directed in a radial direction 110 and projects on both sides past the bar 10. When the armoring element 1 is integrated or embedded in a knife haft, the cavity of the rear transverse part 12 is penetrated by haft material, preferably completely filled by an injected or cast substance. The material bridge formed in this fashion ensures stable embedding of the armoring element 1 in a knife haft. The armoring element 1 shown in FIG. 1*a* can be embedded in a knife haft in such a fashion that both elliptical basic surfaces of the rear transverse part 12 are disposed in an outer surface of the knife haft such that they are visible.

Figure 1B:
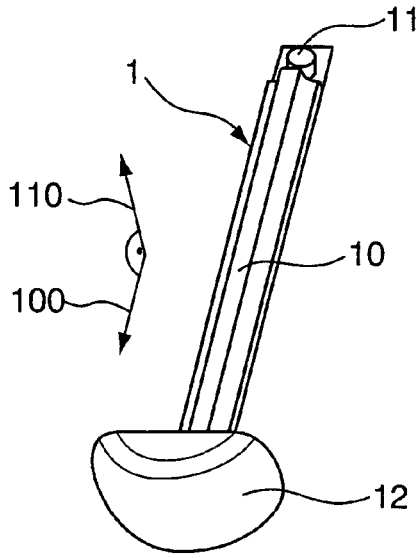

FIG. 1*b* shows an armoring element 1 which has a beam-like bar 10 in the axial direction 100 with a pin-like connecting means 11 in the end area of the bar 10. A shell-shaped rear transverse part 12 is mounted at the end of the bar 10 opposite to the connecting means 11. The armoring element 1 is produced in one piece from metal. When the armoring element 1 of FIG. 1*b* is embedded in a knife haft formed of haft material, the rear transverse part 12 forms the haft head. In this compact knife haft design, the knife haft is secured by the armoring element 1 to prevent it from being rotated, thereby increasing its stability.

Figure 1C:
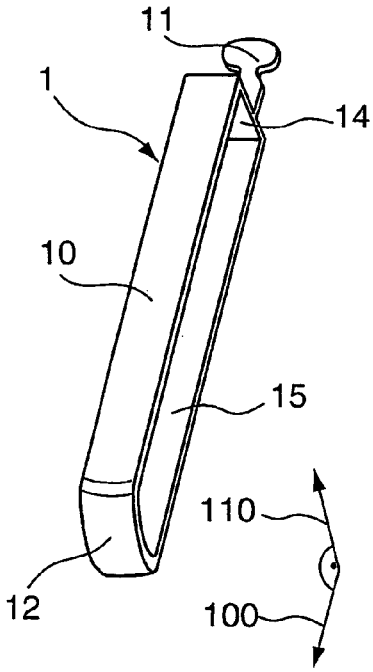

FIG. 1*c* shows an armoring element 1 with a bar 10 extending in an axial direction 100 and a further bar 15 disposed parallel to the bar 10. The two bars 10, 15, are connected to each other via a rear transverse part 12 and a front transverse part 14, wherein the front and rear transverse parts 12, 14 are directed in a radial direction 110. A connecting means 11 is provided in the center of the front transverse part 14 which extends in an axial direction 100 as an extension of the bars 10, 15. The connecting means 11 is designed as a flat connecting head which can positively engage in a corresponding recess of a tang. The armoring element 1 shown in FIG. 1*c* can be inserted into a knife haft such that the bar 10, the additional bar 15 and also the rear transverse part 12 are disposed in the outer surface of the knife haft such that they are visible, wherein the rear transverse part 12 is disposed in the haft head and one of the bars 10, 15 in the haft back.

Figure 1D:
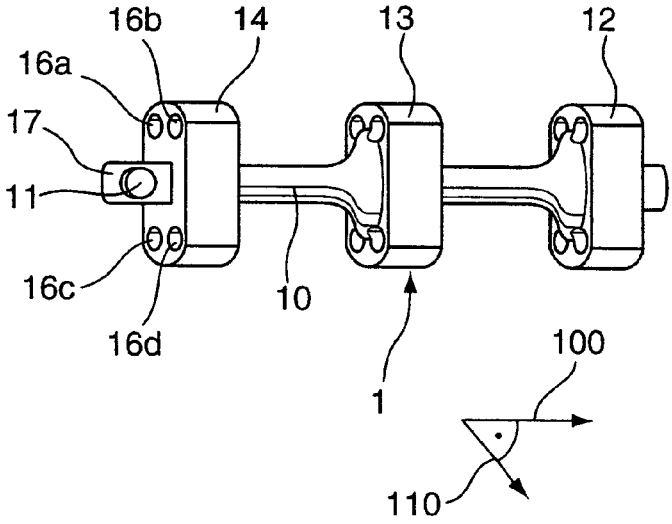

An embodiment of an armoring element 1 shown in FIG. 1*d* has three transverse parts, a rear transverse part 12, a central transverse part 13 and a front transverse part 14 which are provided in regular separations on a bar 10 extending in an axial direction 100, and project past the whole periphery of the bar 10. Each transverse part, like the front transverse part 14, has a first hole 16*a*, a second hole 16*b*, a third hole 16*c*, a fourth hole 16*d* which are disposed at regular separations on the overall periphery of the front transverse part 14 and extend in an axial direction 100. The bar 10, the transverse parts 12, 13, 14 and the holes 16*a*, 16*b*, 16*c*, 16*d* are designed to be mirror-inverted with respect to a central plane of the armoring element 1. One end surface 17 which joins the front transverse part 14 and bears a pin-like connecting means 11 is disposed in the central plane defining the symmetry. The end surface 17 and the connecting means 11 are oriented in a radial direction 110, extending transversely to the axial direction 100, to form a plug connection. The armoring element 1 shown in FIG. 1*d* is preferably embedded in a haft material which is in a liquid state during the production process to generate material paths which extend through the holes 16*a*, 16*b*, 16*c*, 16*d* and are disposed parallel to the bar 10, and which increase the strength of the knife haft and fixation of the armoring element 1 in the knife haft.

Figure 2A:
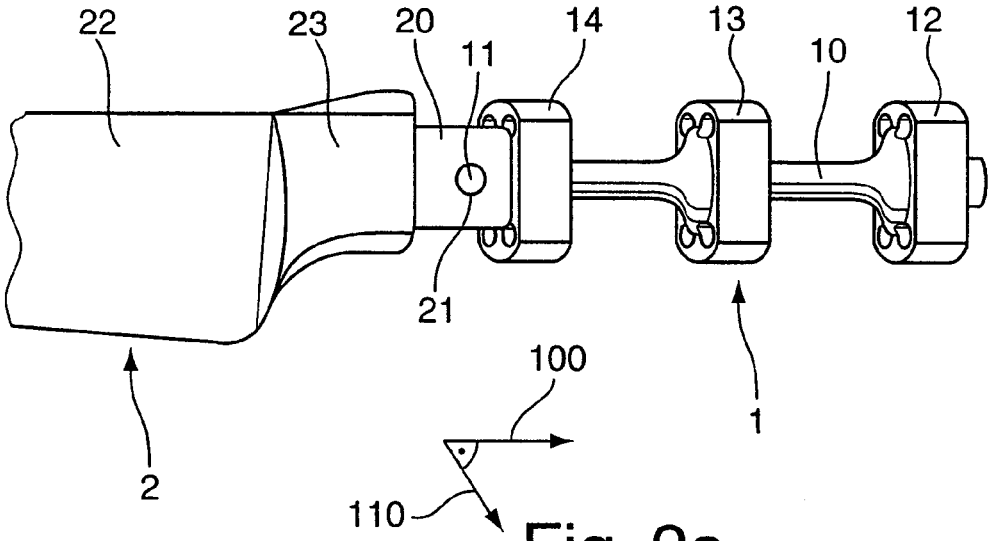
FIG. 2*a* shows a perspective side view of an inventive armoring element connected to the tang of a knife blade.
Figure 2B:
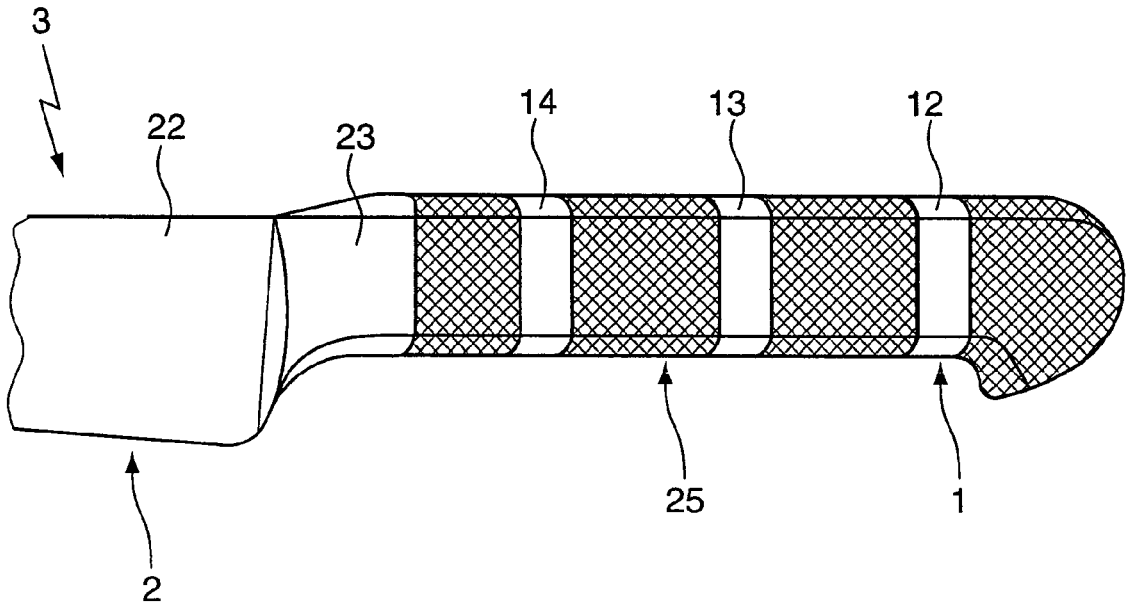
FIG. 2*b* shows a perspective side view of an inventive knife.

FIGS. 2*a* and 2*b* show the inventive method for producing a knife. FIG. 2*a* shows the raw piece of a knife consisting of a knife blade 2 and the armoring element 1 shown in FIG. 1*d* after termination of the first step 1, i.e. connecting the connecting means 11 provided on the armoring element 1 and a counter piece 21 provided on the knife blade 2. In a second step of the inventive method, the haft material is provided at the tang 20 of the knife blade 2 and at the armoring element 1. A knife 3 with a knife haft 25 joined by injecting around it, is shown in FIG. 2*b* after termination of a third method step 3, i.e. hardening of the injected substance.

FIG. 2*a* shows the armoring element 1 of FIG. 1*d* which is connected to a knife blade 2. The knife blade 2 comprises a cutting blade 22 which merges in an axial direction 100 into an offset 23 and subsequently into a tang 20. The knife blade 2 is thereby designed as a forged knife blade and has an offset 23. It is clear that also other blade designs may be connected to the inventive armoring element 1, e.g. a punched knife blade, wherein the tang directly merges into the blade and there is no offset. The tang 20 of the knife blade 2 is a substantially rectangular flat piece which has a counter piece 21 designed as a hole. The armoring element 1 is connected via a plug connection between the counter piece 21 and the connecting means 11 provided on the bar 10 of the armoring element 1 to extend the tang 20 in an axial direction 100. Positive locking between the counter piece 21 and the connecting means 11 is stabilized in that the front transverse part 14 of the armoring element 1 and is flush with a flat end side of the tang 20, thereby preventing tilting and/or rotation of the plug connection. The armoring element 1, in particular, the front transverse part 14, the central transverse part 13 and the rear transverse part 12 are mirror-inverted relative to a central plane of the armoring element 1. In the illustrated embodiment of an inventive connection of the armoring element 1 to the knife blade 2, the plane of the knife blade 22 and the symmetry-defining central plane of the armoring element 1 coincide, which provides the inventive knife with a symmetrical design. The tang 20, which is designed as a flat piece, is disposed in the mentioned plane. The plug connection is oriented 110 perpendicularly to the mentioned plane. This is advantageous in that the release or break-out direction 110 of the plug connection is not loaded or stressed during normal use of the knife.

FIG. 2*b* shows an inventive knife 3 with the knife blade 2, the armoring element 1 and the knife haft 25. The knife haft 25 largely consists of a hardened injected substance, alternatively a hardened cast substance which largely surrounds the armoring element 1 and the tang (not shown). After finishing the knife 3, only the blade 22 and the head 23 of the knife blade 2 are visible. The front transverse part 14, the central transverse part 13 and the rear transverse part 12 of the armoring element 1 are visibly disposed in the outer surface of the knife haft 25 as design elements.

Further band or skeleton-like armoring elements of a knife haft with one or more bars and one or more, differently designed transverse parts are feasible. The armoring element 1 may moreover also be connected to the knife blade 2 via several connecting means. Additional fixing of the connection between connecting means and the tang 20 through gluing, hooks, welding or other types of mounting of corresponding surfaces and/or projections is also feasible.

The invention comprises an armoring element 1 of a knife haft 25 which has a bar 10 extending in an axial direction 100 and is connected to the tang 20 of a knife blade 2 using a connecting means 11. A secure, frictional connection in an axial direction 100 between the armoring element 1 and the knife blade 2 is formed by positive locking and/or material bonding between the connecting means 11 of the armoring element 1 and a corresponding counter piece 21 on the tang 20 of the knife blade 2. In an inventive method for producing a knife 3, the tang 20 and the armoring element 1 are jacketed by haft material, e.g. haft shells, in the connected state. The haft material forms the actual body of the knife haft 25, wherein partial surfaces of the armoring element 1 may be disposed in the outer surface of the knife haft 25 such that they are visible.

We claim:

1. A method for producing a knife, the method comprising the steps of:

a) preparing an armoring element having at least one bar extending in an axial direction and at least one connecting means disposed at an end of said bar, wherein at least one transverse part is provided on said at least one bar, which radially projects past said bar, said at least one transverse part having holes extending in said axial direction;

b) preparing a knife blade having a tang bearing a counter piece;

c) connecting said counter piece to said connecting means, said connecting means and said counter piece communicating with each other in a secure, frictional fashion in a transverse direction, wherein a front side of said transverse part is flush with a flat end of said tang, thereby preventing tilting and rotation of said knife blade relative to said armoring element; and d) applying a haft material to at least partially surround said tang and said armoring element, said haft material extending into said holes of said transverse part, thereby increasing a strength of fixation of said armoring element in said haft material.

2. The method of claim 1, wherein, in step d), a hardenable injection or casting substance is injected or cast around the tang and the armoring element and further comprising the step of hardening the injected or cast substance.

3. The method of claim 1, wherein, in step d), the tang or the armoring element are coated in such a fashion that at least parts of a surface of the armoring element are in an outer surface of the knife haft.

4. A knife comprising:

an armoring element having at least one bar extending in an axial direction and at least one connecting means disposed at an end of said bar, wherein at least one transverse part is provided on said at least one bar, which radially projects past said bar, said at least one transverse part having holes extending in said axial direction;

a knife blade having a tang bearing a counter piece mating with said connecting means, said connecting means and said counter piece communicating with each other in a secure, frictional fashion in a transverse direction, wherein a front side of said transverse part is flush with a flat end of said tang, thereby preventing tilting and rotation of said knife blade relative to said armoring element; and a haft material at least partially surrounding said tang and said armoring element, said haft material extending into said holes of said transverse part, thereby increasing a strength of fixation of said armoring element in said haft material.

5. The knife of claim 4, wherein the armoring element is made from metal.

6. The knife of claim 4, wherein said connecting means is disposed in an end area of said bar and is a formed-on piece, a projection, or defines a recess or a hole.

7. The knife of claim 4, wherein said connecting means is oriented transversely to an axial extension of said bar.

8. The knife of claim 4, wherein said at least one bar and said at least one transverse part are at least approximately mirror-inverted relative to a central plane of the armoring element.

9. The knife of claim 4, wherein the armoring element is formed in one piece.

10. The knife of claim 4, wherein said haft material is a hardenable injected or cast substance.

11. The knife of claim 4, wherein said tang is disposed in a plane of said knife blade.

* * * * *